US011763747B1

(12) United States Patent
Zhou et al.

(10) Patent No.: US 11,763,747 B1
(45) Date of Patent: Sep. 19, 2023

(54) PIXEL DRIVING CIRCUIT, DISPLAY PANEL, AND DISPLAY DEVICE

(71) Applicant: HKC CORPORATION LIMITED, Guangdong (CN)

(72) Inventors: Renjie Zhou, Guangdong (CN); Haoxuan Zheng, Guangdong (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 18/330,997

(22) Filed: Jun. 7, 2023

(30) Foreign Application Priority Data

Oct. 12, 2022 (CN) ..... 202211248819.0

(51) Int. Cl.
*G09G 3/3233* (2016.01)

(52) U.S. Cl.
CPC ... *G09G 3/3233* (2013.01); *G09G 2300/0819* (2013.01); *G09G 2320/041* (2013.01); *G09G 2330/08* (2013.01)

(58) Field of Classification Search
CPC ..... G09G 3/3233; G09G 2300/0819; G09G 2320/041; G09G 2330/08
See application file for complete search history.

(56) References Cited

U.S. PATENT DOCUMENTS

| | | | | |
|---|---|---|---|---|
| 9,881,544 | B2 * | 1/2018 | Qing | G09G 3/3233 |
| 10,366,654 | B2 * | 7/2019 | Chang | G09G 3/3258 |
| 2012/0306374 | A1 | 12/2012 | Lee et al. | |
| 2015/0206476 | A1 * | 7/2015 | Qi | G09G 3/3258 345/82 |
| 2022/0215795 | A1 * | 7/2022 | Yue | G09G 3/2074 |

FOREIGN PATENT DOCUMENTS

| | | | |
|---|---|---|---|
| CN | 1231046 | A | 10/1999 |
| CN | 103366682 | A | 10/2013 |
| CN | 103531148 | A | 1/2014 |
| CN | 107731163 | A | 2/2018 |
| CN | 111028766 | A | 4/2020 |
| CN | 112967668 | A | 6/2021 |
| CN | 114333690 | A | 4/2022 |
| CN | 115171591 | A | 10/2022 |
| WO | 2021083155 | A1 | 5/2021 |

OTHER PUBLICATIONS

The first office action issued in corresponding CN application No. 202211248819.0 dated Nov. 23, 2022.

* cited by examiner

*Primary Examiner* — Jeff Piziali
(74) *Attorney, Agent, or Firm* — HAUPTMAN HAM, LLP

(57) ABSTRACT

A pixel driving circuit, a display panel, and a display device are provided. A first driving module and a second driving module of the pixel driving circuit each are electrically connected with a light-emitting unit, a first power-supply terminal, and a second power-supply terminal. The first driving module is configured to receive a first voltage from the first power-supply terminal and receive a second voltage from the second power-supply terminal according to a first scanning signal and a data signal. The second driving module is configured to receive the second voltage from the first power-supply terminal and receive the first voltage from the second power-supply terminal according to a second scanning signal and the data signal. The first driving module and the second driving module alternately drive the light-emitting unit to emit a light.

20 Claims, 3 Drawing Sheets

PIXEL DRIVING CIRCUIT, DISPLAY PANEL, AND DISPLAY DEVICE

CROSS-REFERENCE TO RELATED APPLICATIONS

This application claims priority under 35 U.S.C. § 119(a) to Chinese Patent Application No. 202211248819.0, filed Oct. 12, 2022, the entire disclosure of which is incorporated herein by reference.

TECHNICAL FIELD

This disclosure relates to the field of display technology, and in particular to a pixel driving circuit, a display panel including the pixel driving circuit, and a display device including the display panel.

BACKGROUND

As a new generation of display technology, Micro Light Emitting Diodes (Micro LEDs) have advantages of being lighter and thinner, high brightness, low power consumption, quick response, high definition, good flexibility, high light-emitting efficiency, high contrast, etc., and can meet new requirements of consumers for the display technology, so the Micro LEDs are widely applied to various display devices, such as Micro LED display panels, Organic Light Emitting Diode (OLED) display panels.

SUMMARY

In a first aspect, a pixel driving circuit is provided in the present disclosure. The pixel driving circuit includes a first driving module, a light-emitting unit and a second driving module. The first driving module and the second driving module each are electrically connected with the light-emitting unit, a first power-supply terminal, and a second power-supply terminal. The first driving module is configured to receive a first scanning signal and a data signal, and selectively receive a first voltage from the first power-supply terminal and receive a second voltage from the second power-supply terminal according to the first scanning signal and the data signal. The second driving module is configured to receive a second scanning signal and the data signal, and selectively receive the second voltage from the first power-supply terminal and receive the first voltage from the second power-supply terminal according to the second scanning signal and the data signal. The first voltage and the second voltage that are received by the first driving module and the first voltage and the second voltage that are received by the second driving module are used to be alternately applied across the light-emitting unit, to drive the light-emitting unit to emit a light.

In a second aspect, a display panel is provided in the present disclosure. The display panel includes a signal controller and several above-mentioned pixel driving circuits. The several pixel driving circuit each include a first driving module, a light-emitting unit and a second driving module. The first driving module and the second driving module each are electrically connected with the light-emitting unit, a first power-supply terminal, and a second power-supply terminal. The first driving module is configured to receive a first scanning signal and a data signal, and selectively receive a first voltage from the first power-supply terminal and receive a second voltage from the second power-supply terminal according to the first scanning signal and the data signal. The second driving module is configured to receive a second scanning signal and the data signal, and selectively receive the second voltage from the first power-supply terminal and receive the first voltage from the second power-supply terminal according to the second scanning signal and the data signal. The first voltage and the second voltage that are received by the first driving module and the first voltage and the second voltage that are received by the second driving module are used to be alternately applied across the light-emitting unit, to drive the light-emitting unit to emit a light. The signal controller is configured to provide the several pixel driving circuits with the first scanning signal and the second scanning signal.

In a third aspect, a display device is provided in the present disclosure. The display device includes a power-supply module and the above-mentioned display panel. The power-supply module is configured to supply power to the display panel. The display panel includes a signal controller and several above-mentioned pixel driving circuits. The several pixel driving circuit each include a first driving module, a light-emitting unit and a second driving module. The first driving module and the second driving module each are electrically connected with the light-emitting unit, a first power-supply terminal, and a second power-supply terminal. The first driving module is configured to receive a first scanning signal and a data signal, and selectively receive a first voltage from the first power-supply terminal and receive a second voltage from the second power-supply terminal according to the first scanning signal and the data signal. The second driving module is configured to receive a second scanning signal and the data signal, and selectively receive the second voltage from the first power-supply terminal and receive the first voltage from the second power-supply terminal according to the second scanning signal and the data signal. The first voltage and the second voltage that are received by the first driving module and the first voltage and the second voltage that are received by the second driving module are used to be alternately applied across the light-emitting unit, to drive the light-emitting unit to emit a light. The signal controller is configured to provide the several pixel driving circuits with the first scanning signal and the second scanning signal.

BRIEF DESCRIPTION OF THE DRAWINGS

To explain technical solutions in implementations of the present disclosure more clearly, the following will give a brief introduction to accompanying drawings which are needed to be used in description of implementations. Apparently, the accompanying drawings in the following description are some implementations of the present disclosure. For those of ordinary skill in the art, other accompanying drawings can be obtained according to these accompanying drawings without creative efforts.

REFERENCE SIGNS

Figure 1:
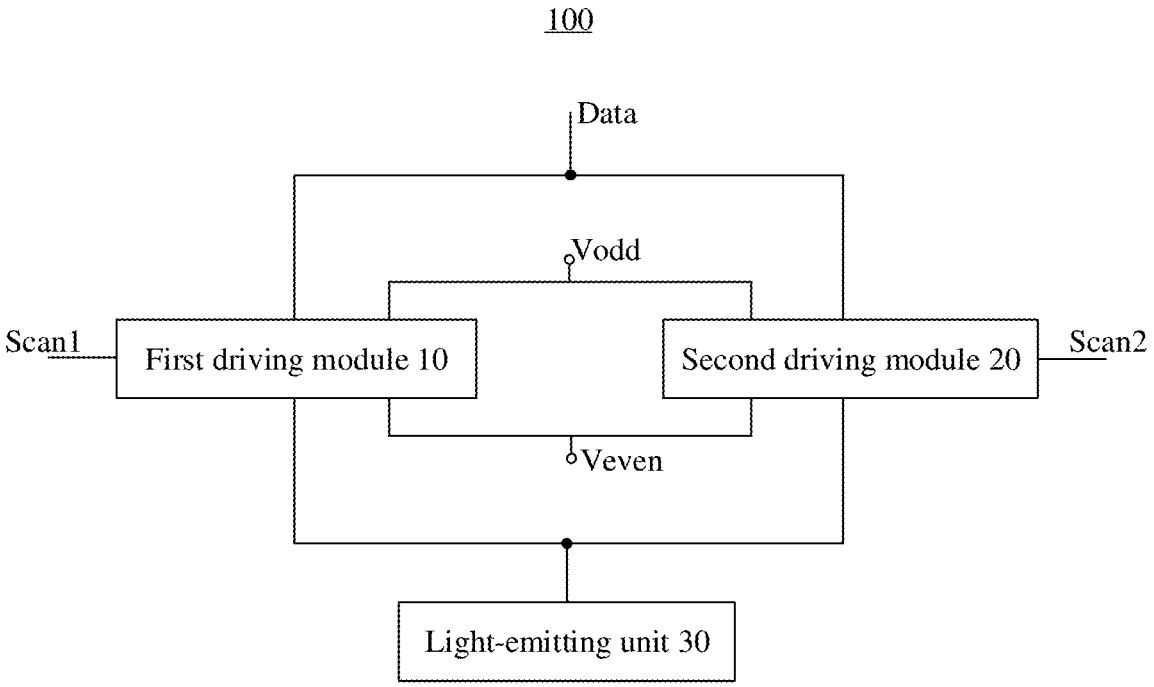
FIG. 1 is a schematic diagram of a circuit structure of a pixel driving circuit disclosed in implementations of the present disclosure.

100—pixel driving circuit; 10—first driving module; 20—second driving module; 30—light-emitting unit; 31—light-emitting element; 12—first light-emitting driving circuit; 14—second light-emitting driving circuit; 12*a*—first transistor; 12*b*—second transistor; 14*a*—third transistor; 22—third light-emitting driving circuit; 24—fourth light-emitting driving circuit; 22*a*—fourth transistor; 22*b*—fifth transistor; 24*a*—sixth transistor; 50—signal short-circuit; 52—first switch sub-circuit; 54—second switch sub-circuit; 52*a*—first shared transistor; 54*a*—second shared transistor; Data—data signal; Vodd—first power-supply terminal; Veven—second power-supply terminal; Scan1—first scanning signal; Scan2—second scanning signal; Scan3—third scanning signal; t1~t4—different periods of driving sequence diagram.

DETAILED DESCRIPTION

To facilitate understanding of the present disclosure, a comprehensive description will be given below with reference to related accompanying drawings. The accompanying drawings illustrate some exemplary implementations of the present disclosure. However, the present disclosure can be implemented in many different forms and is not limited to implementations described herein. On the contrary, these implementations are provided for a more thorough and comprehensive understanding of the present disclosure.

The following implementations are described with reference to accompanying drawings to illustrate particular implementations in which the present disclosure may be implemented. The serial numbers assigned herein for the components themselves, such as "first", "second", etc., are only used to distinguish between objects described and do not have any sequential or technical meaning. The "connection" and "coupling" in the present disclosure, unless otherwise specified, include direct and indirect connection (coupling). Direction terms mentioned in the present disclosure, such as "up", "down", "front", "back", "left", "right", "inside", "outside", "side surface", etc., are only directions with reference to the directions of the accompanying drawings. Therefore, the direction terms are used for better and clearer illustration and understanding of the present disclosure, and are not intended to indicate or imply that the device or component must have a specific orientation, be constructed and operated in the particular orientation, and therefore cannot be construed as limiting to the present disclosure.

In the description of the present disclosure, it should be noted that unless otherwise expressly specified or defined, terms such as "disposed", "arranged", "provided with", "mount", "couple", and "connect" should be understood broadly, and for example, a fixed connection, or a detachable connection, or an integrated connection; may be a mechanical connection; and may be a direct connection, or an indirect connection via an intermediate medium, or may be an internal communication between two components. The specific meanings of the above-mentioned terms in the present disclosure could be understood by those of ordinary skill in the art according to specific situations. It should be noted that the terms "first", "second", etc. in the specification, claims and accompanying drawings of the present disclosure are used to distinguish different objects, rather than to describe a specific order. In addition, terms "comprise", "may comprise", "include", or "may include" used in the present disclosure indicate the existence of corresponding functions, operations, components, etc., which are disclosed, and do not limit one or more other functions, operations, components, etc. Moreover, the terms "comprise" or "include" indicate the existence of corresponding features, numbers, steps, operations, elements, components, or combinations thereof disclosed in the specification, and do not exclude the existence or addition of one or more other features, numbers, steps, operations, elements, components, or combinations thereof, with the intent of covering non-exclusive inclusion. It is also to be understood that as described herein, "at least one" means one and more than one, e.g., one, two, three, etc., while "multiple" or "a plurality of" means at least two, e.g., two or three, etc., unless otherwise specifically defined. The terms "step 1", "step 2", etc., in the description, claims, and the accompanying drawings of the present disclosure are used to distinguishing different objects, rather than to describe a specific order.

Unless otherwise defined, all technical and scientific terms used herein have the same meaning as commonly understood by those skilled in the art of the present disclosure. The terms used herein in the specification of the present disclosure are for the purpose of describing specific implementations only and are not intended to limit the present disclosure.

However, a Micro LED display panel or an OLED display panel in the related art is usually driven by Direct Current (DC), and this DC driving mode causes a relatively high operating temperature of a driving transistor of a pixel driving circuit, such that service life of the driving transistor is significantly shortened, and the overall power consumption of the display panel is increased.

In view of shortcomings of the related art, the present disclosure aims to provide a pixel driving circuit, a display panel, and a display device. Each transistor of the pixel driving circuit can transmit a voltage intermittently, and heat generated due to transmission of the voltage is released during an intermittent period, such that an operating temperature of each transistor is reduced, and service life of each transistor is prolonged.

In a first aspect, a pixel driving circuit is provided in the present disclosure. The pixel driving circuit includes a first driving module, a light-emitting unit and a second driving module. The first driving module and the second driving module each are electrically connected with the light-emitting unit, a first power-supply terminal, and a second power-supply terminal. The first driving module is configured to receive a first scanning signal and a data signal, and selectively receive a first voltage from the first power-supply terminal and receive a second voltage from the second power-supply terminal according to the first scanning signal and the data signal. The second driving module is configured to receive a second scanning signal and the data signal, and selectively receive the second voltage from the first power-supply terminal and receive the first voltage from the second power-supply terminal according to the second scanning signal and the data signal. The first voltage and the second voltage that are received by the first driving module and the first voltage and the second voltage that are received by the second driving module are used to be alternately applied across the light-emitting unit, to drive the light-emitting unit to emit a light.

In some implementations, the first driving module includes a first light-emitting driving circuit and a second light-emitting driving circuit. The first light-emitting driving circuit has a first terminal electrically connected with the first power-supply terminal to receive the first voltage from the first power-supply terminal, and a second terminal electrically connected with the light-emitting unit. The second light-emitting driving circuit has a first end electrically connected with the light-emitting unit, and a second end electrically connected with the second power-supply terminal to receive the second voltage from the second power-supply terminal.

In some implementations, the second driving module includes a third light-emitting driving circuit and a fourth light-emitting driving circuit. The third light-emitting driving circuit has a first end electrically connected with the second power-supply terminal to receive the first voltage from the second power-supply terminal, and a second end electrically connected with the light-emitting unit. The fourth light-emitting driving circuit has a first end electrically connected with the first power-supply terminal to receive the second voltage from the first power-supply terminal, and a second end electrically connected with the light-emitting unit.

In some implementations, the light-emitting unit includes a light-emitting element. The light-emitting element has a first terminal and a second terminal. The first terminal of the light-emitting element and the second terminal of the light-emitting element each are electrically connected with the first driving module and the second driving module.

In some implementations, the first light-emitting driving circuit includes a first transistor and a second transistor. The second light-emitting driving circuit includes a third transistor. The first transistor has a control terminal for receiving the data signal, a first terminal electrically connected with the first power-supply terminal to receive the first voltage from the first power-supply terminal, and a second terminal electrically connected with a first terminal of the second transistor. The second transistor has a control terminal for receiving the first scanning signal, and a second terminal electrically connected with the first terminal of the light-emitting element. The third transistor has a control terminal for receiving the first scanning signal, a first terminal electrically connected with the second terminal of the light-emitting element, and a second terminal electrically connected with the second power-supply terminal to receive the second voltage from the second power-supply terminal.

In some implementations, the third light-emitting driving circuit includes a fourth transistor and a fifth transistor. The fourth light-emitting driving circuit includes a sixth transistor. The fourth transistor has a control terminal for receiving the data signal, a first terminal electrically connected with the second power-supply terminal to receive the first voltage from the second power-supply terminal, and a second terminal electrically connected with a first terminal of the fifth transistor. The fifth transistor has a control terminal for receiving the second scanning signal, and a second terminal electrically connected with the first terminal of the light-emitting element. The sixth transistor has a control terminal for receiving the second scanning signal, a first terminal electrically connected with the second terminal of the light-emitting element, and a second terminal electrically connected with the first power-supply terminal to receive the second voltage from the first power-supply terminal.

In some implementations, when the control terminal of the first transistor receives the data signal and the first scanning signal is at a first level, the first transistor, the second transistor, and the third transistor each are in an on state. The first voltage is transmitted to the first terminal of the light-emitting element through the first transistor and the second transistor. The second voltage is transmitted to the second terminal of the light-emitting element through the third transistor. The light-emitting element is driven by the first voltage and the second voltage to emit the light. When the control terminal of the fourth transistor receives the data signal and the second scanning signal is at the first level, the fourth transistor, the fifth transistor, and the sixth transistor each are in an on state. The first voltage is transmitted to the first terminal of the light-emitting element through the fourth transistor and the fifth transistor. The second voltage is transmitted to the second terminal of the light-emitting element through the sixth transistor. The light-emitting element is driven by the first voltage and the second voltage to emit the light.

In some implementations, the pixel driving circuit includes a signal short-circuit. The signal short-circuit includes several switch sub-circuits. The several switch sub-circuits each are electrically connected with both the first driving module and the second driving module. During switch between the first driving module and the second driving module to drive the light-emitting unit to emit the light, the first scanning signal and the second scanning signal are short-circuited by each of the several switch sub-circuits.

In a second aspect, a display panel is provided in the present disclosure. The display panel includes a signal controller and several above-mentioned pixel driving circuits. The several pixel driving circuit each include a first driving module, a light-emitting unit and a second driving module. The first driving module and the second driving module each are electrically connected with the light-emitting unit, a first power-supply terminal, and a second power-supply terminal. The first driving module is configured to receive a first scanning signal and a data signal, and selectively receive a first voltage from the first power-supply terminal and receive a second voltage from the second power-supply terminal according to the first scanning signal and the data signal. The second driving module is configured to receive a second scanning signal and the data signal, and selectively receive the second voltage from the first power-supply terminal and receive the first voltage from the second power-supply terminal according to the second scanning signal and the data signal. The first voltage and the second voltage that are received by the first driving module and the first voltage and the second voltage that are received by the second driving module are used to be alternately applied across the light-emitting unit, to drive the light-emitting unit to emit a light. The signal controller is configured to provide the several pixel driving circuits with the first scanning signal and the second scanning signal.

In a third aspect, a display device is provided in the present disclosure. The display device includes a power-supply module and the above-mentioned display panel. The power-supply module is configured to supply power to the display panel. The display panel includes a signal controller and several above-mentioned pixel driving circuits. The several pixel driving circuit each include a first driving module, a light-emitting unit and a second driving module. The first driving module and the second driving module each are electrically connected with the light-emitting unit, a first power-supply terminal, and a second power-supply terminal. The first driving module is configured to receive a first scanning signal and a data signal, and selectively receive a first voltage from the first power-supply terminal and receive a second voltage from the second power-supply terminal according to the first scanning signal and the data signal. The second driving module is configured to receive a second scanning signal and the data signal, and selectively receive the second voltage from the first power-supply terminal and receive the first voltage from the second power-supply terminal according to the second scanning signal and the data signal. The first voltage and the second voltage that are received by the first driving module and the first voltage and the second voltage that are received by the second driving module are used to be alternately applied across the light-emitting unit, to drive the light-emitting unit to emit a light. The signal controller is configured to provide the several pixel driving circuits with the first scanning signal and the second scanning signal.

In summary, in the pixel driving circuit, the display panel, and the display device of the present disclosure, the pixel driving circuit is provided with the first driving module and the second driving module, the first driving module is provided with the first light-emitting driving circuit and the second light-emitting driving circuit, the first light-emitting driving circuit can apply the first voltage to the light-emitting element, and the second light-emitting driving circuit can apply the second voltage to the light-emitting element.

The second driving module is provided with the third light-emitting driving circuit and the fourth light-emitting driving circuit, the third light-emitting driving circuit can apply the first voltage to the light-emitting element, and the fourth light-emitting driving circuit can apply the second voltage to the light-emitting element. By controlling a level of the first scanning signal transmitted to the first driving module and a level of the second scanning signal transmitted to the second driving module, the first driving module and the second driving module alternately drive the light-emitting unit to emit the light. Therefore, transistors of the first driving module and transistors of the second driving module can transmit the voltage intermittently, and the heat generated due to transmission of the voltage is released during the intermittent period, thereby reducing the operating temperature of each transistor, which is beneficial to prolonging the service life of each transistor, and further prolonging the service life of the display panel and the display device.

In addition, the pixel driving circuit is provided with the signal short-circuit, and during the switch between the first driving module and the second driving module to drive the light-emitting unit to emit the light, the first scanning signal and the second scanning signal are short-circuited by the signal short-circuit, so as to realize charge sharing between the first scanning signal and the second scanning signal. Therefore, power consumption required for switch between the level of the first scanning signal and the level of the second scanning signal can be reduced, thereby reducing power consumption of the pixel driving circuit, and further effectively reducing power consumption of the display panel and power consumption of the display device.

Referring to FIG. 1, FIG. 1 is a schematic diagram of a circuit structure of a pixel driving circuit 100 disclosed in implementations of the present disclosure. As illustrated in FIG. 1, the pixel driving circuit 100 provided in implementations of the present disclosure includes a first driving module 10, a second driving module 20, and a light-emitting unit 30. The first driving module 10 and the second driving module 20 each are electrically connected with the light-emitting unit 30, a first power-supply terminal Vodd, and a second power-supply terminal Veven.

The first driving module 10 is configured to receive a first scanning signal Scan1 and a data signal Data, and receive a first voltage from the first power-supply terminal Vodd and a second voltage from the second power-supply terminal Veven according to the first scanning signal Scan1 and the data signal Data. The second driving module 20 is configured to receive a second scanning signal Scan2 and the data signal Data, and receive the second voltage from the first power-supply terminal Vodd and the first voltage from the second power-supply terminal Veven according to the second scanning signal Scan2 and the data signal Data.

The first voltage and the second voltage that are received by the first driving module 10 and the first voltage and the second voltage that are received by the second driving module 20 are used to be alternately applied across the light-emitting unit 30, to drive the light-emitting unit 30 to emit a light. In other words, the first driving module 10 can receive the first voltage and the second voltage, the second driving module 20 can also receive the first voltage and the second voltage, and the pixel driving circuit 100 can switch between the first driving module 10 and the second driving module 20 to apply both the first voltage and the second voltage across the light-emitting unit 30, to drive the light-emitting unit 30 to emit the light.

In implementations of the present disclosure, by disposing the first driving module 10 and the second driving module 20 to alternatively drive the light-emitting unit 30 to emit the light, such that a driving component of the first driving module 10 and a driving component of the second driving module 20 each are driven by Alternating Current (AC) and can operate intermittently, which is beneficial for the driving components to release the heat generated during operating in time, thereby effectively reducing the operating temperature of the driving components and further prolonging the service life of the driving components.

Figure 2:
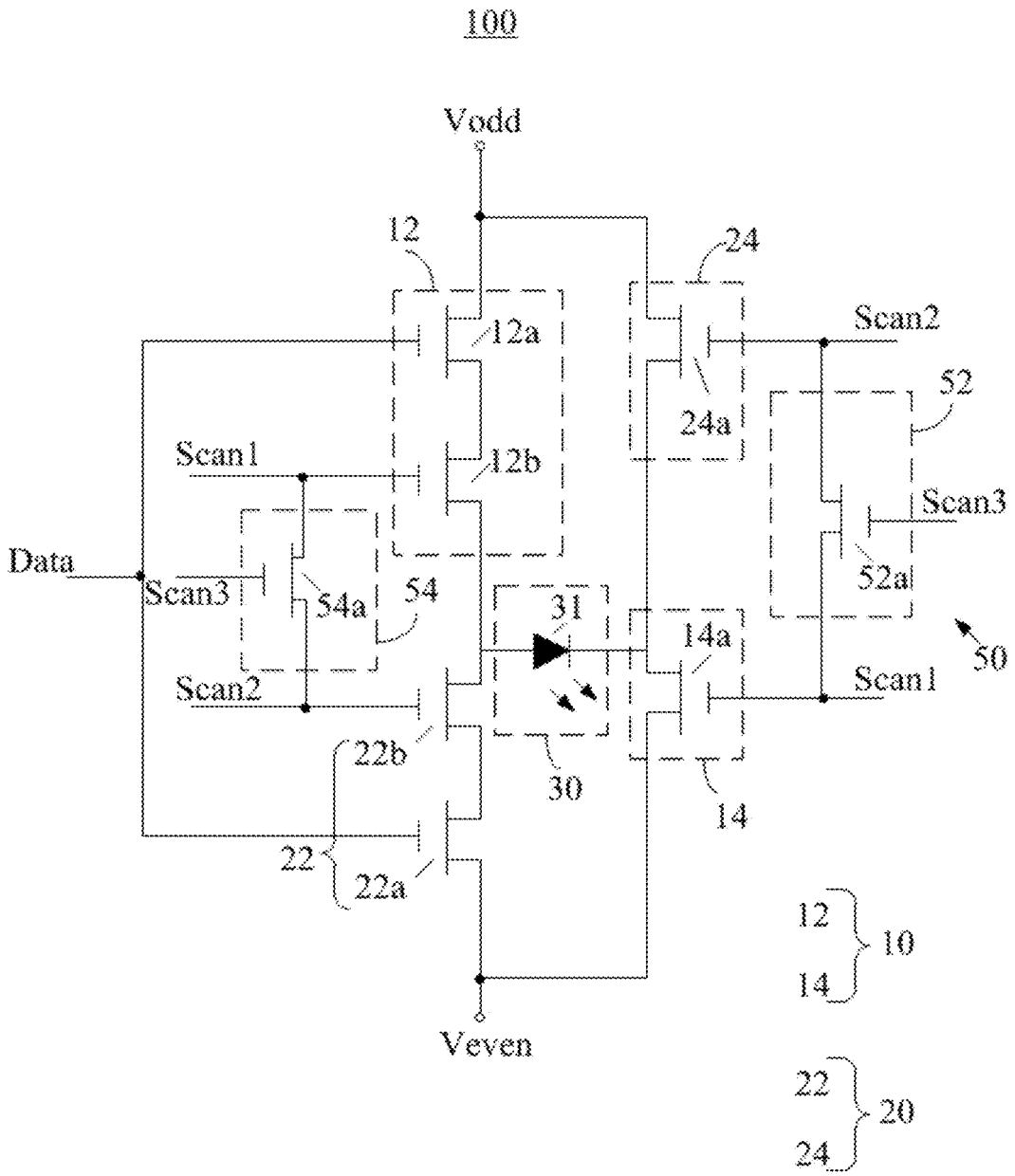
FIG. 2 is a schematic diagram of a circuit structure of the pixel driving circuit illustrated in FIG. 1.

Referring to FIG. 2, FIG. 2 is a schematic diagram of a circuit structure of the pixel driving circuit 100 illustrated in FIG. 1. In implementations of the present disclosure, the light-emitting unit 30 may include a light-emitting element 31. The light-emitting element 31 includes a first terminal and a second terminal. The first terminal of the light-emitting element 31 and the second terminal of the light-emitting element 31 each are electrically connected with the first driving module 10 and the second driving module 20. The first driving module 10 is configured to apply the first voltage and the second voltage across the light-emitting element 31, to drive the light-emitting element 31 to emit the light, and the second driving module 10 is configured to apply the first voltage and the second voltage across the light-emitting element 31, to drive the light-emitting element 31 to emit the light.

In an implementation of the present disclosure, the first terminal of the light-emitting element 31 may be an anode, and the second terminal of the light-emitting element 31 may be a cathode, which are not specifically limited in the present disclosure.

In an implementation of the present disclosure, the light-emitting element 31 may be an Organic Light Emitting Diode (OLED) or a Micro Light Emitting Diode (Micro LED), which is not specifically limited in the present disclosure.

In implementations of the present disclosure, the first driving mode 10 includes a first light-emitting driving circuit 12 and a second light-emitting driving circuit 14. The first light-emitting driving circuit 12 is configured to provide the first voltage for the light-emitting unit 30. The second light-emitting driving circuit 14 is configured to provide the second voltage for the light-emitting unit 30.

The first light-emitting driving circuit 112 has a first end electrically connected with the first power-supply terminal Vodd to receive the first voltage from the first power-supply terminal Vodd, and a second end electrically connected with the light-emitting unit 30. When the first light-emitting driving circuit 12 receives the data signal Data and the first scanning signal Scan1 that is at a first level, the first voltage is transmitted to the light-emitting unit 30 through the first light-emitting driving circuit 12. Specifically, the first voltage is transmitted to the first terminal of the light-emitting element 31 through the first light-emitting driving circuit 12.

The second light-emitting driving circuit 14 has a first end electrically connected with the light-emitting unit 30, and a second end electrically connected with the second power-supply terminal Veven to receive the second voltage from the second power-supply terminal Veven. When the second light-emitting driving circuit 114 receives the data signal Data and the first scanning signal Scan1 that is at the first level, the second voltage is transmitted to the light-emitting unit 30 through the second light-emitting driving circuit 14. Specifically, the second voltage is transmitted to the second terminal of the light-emitting element 31 through the second light-emitting driving circuit 14.

Here, the first voltage is transmitted to the first terminal of the light-emitting element 31 through the first light-emitting driving circuit 12, the second voltage is transmitted to the second terminal of the light-emitting element 31 through the second light-emitting driving circuit 14, and the light-emitting element 31 is driven by the first voltage applied to the light-emitting element 31 and the second voltage applied to the light-emitting element 31 to emit the light.

As illustrated in FIG. 2, in an implementation of the present disclosure, the first light-emitting driving circuit 12 may include a first transistor 12*a* and a second transistor 12*b*, and the first light-emitting driving circuit 12 is configured to receive the first voltage from the first power-supply terminal Vodd and selectively transmit the first voltage to the light-emitting unit 30. The first transistor 12*a* and the second transistor 12*b* connected in series are connected between the first terminal of the first power-supply terminal Vodd and the light-emitting element 31. Specifically, the first transistor 12*a* and the second transistor 12*b* each have a control terminal, a first terminal, and a second terminal. The first transistor 12*a* has the control terminal for receiving the data signal Data, the first terminal electrically connected with the first power-supply terminal Vodd to receive the first voltage from the first power-supply terminal Vodd, and the second terminal electrically connected with the first terminal of the second transistor 12*b*. The second transistor 12*b* has the control terminal for receiving the first scanning signal Scan1, and the second terminal electrically connected with the first terminal of the light-emitting element 31.

When the control terminal of the first transistor 12*a* receives the data signal Data and the first scanning signal Scan1 is at a first level, the first transistor 12*a* and the second transistor 12*b* each are in an on state, and the first voltage is transmitted to the first terminal of the light-emitting element 31 through the first transistor 12*a* and the second transistor 12*b*.

When the control terminal of the first transistor 12*a* receives the data signal Data and the first scanning signal Scan1 is at a second level, the first transistor 12*a* is in an on state, and the second transistor 12*b* is in an off state. The first voltage is unable to be transmitted from the first transistor 12*a* and the second transistor 12*b* to the first terminal of the light-emitting element 31.

In an implementation of the present disclosure, the second light-emitting driving circuit 14 may include a third transistor 14*a*. The third transistor 14*a* has a control terminal, a first terminal, and a second terminal. The third transistor 14*a* has the control terminal for receiving the first scanning signal Scan1, the first terminal electrically connected with the second terminal of the light-emitting element 31, and the second terminal electrically connected with the second power-supply terminal Veven to receive the second voltage from the second power-supply terminal Veven.

When the first scanning signal Scan1 received by the third transistor 14*a* is at the first level, the third transistor 14*a* is in an on state, and the second voltage is transmitted to the second terminal of the light-emitting element 31 through the third transistor 14*a*.

When the first scanning signal Scan1 received by the third transistor 14*a* is at the second level, the third transistor 14*a* is in an off state, and the second voltage is unable to be transmitted to the second terminal of the light-emitting element 31 through the third transistor 14*a*.

As illustrated in FIG. 2, in implementations of the present disclosure, the second driving module 20 includes a third light-emitting driving circuit 22 and a fourth light-emitting driving circuit 24. The third light-emitting driving circuit 22 is configured to provide the first voltage for the light-emitting unit 30. The fourth light-emitting driving circuit 24 is configured to provide the second voltage for the light-emitting unit 30.

The third light-emitting driving circuit 22 has a first end electrically connected with the second power-supply terminal Veven to receive the first voltage from the second power-supply terminal Veven, and a second end electrically connected with the light-emitting unit 30. When the third light-emitting driving circuit 22 receives the data signal Data and the second scanning signal Scan2 that is at the first level, the first voltage is transmitted to the light-emitting unit 30 through the third light-emitting driving circuit 22. Specifically, the first voltage is transmitted to the first terminal of the light-emitting element 31 through the third light-emitting driving circuit 22.

The fourth light-emitting driving circuit 24 has a first end electrically connected with the first power-supply terminal Vodd to receive the second voltage from the first power-supply terminal Vodd, and a second end electrically connected with the light-emitting unit 30. When the fourth light-emitting driving circuit 24 receives the data signal Data and the second scanning signal Scan2 that is at the first level, the second voltage is transmitted to the light-emitting unit 30 through the fourth light-emitting driving circuit 24. Specifically, the second voltage is transmitted to the second terminal of the light-emitting element 31 through the fourth light-emitting driving circuit 24.

Here, the first voltage is transmitted to the first terminal of the light-emitting element 31 through the third light-emitting driving circuit 22, the second voltage is transmitted to the second terminal of the light-emitting element 31 through the fourth light-emitting driving circuit 24, and the light-emitting element 31 is driven by the first voltage applied to the light-emitting element 31 and the second voltage applied to the light-emitting element 31 to emit the light.

As illustrated in FIG. 2, in an implementation of the present disclosure, the third light-emitting driving circuit 22 may include a fourth transistor 22*a* and the fifth transistor 22*b*, and the third light-emitting driving circuit 22 is configured to receive the first voltage from the second power-supply terminal Veven, and selectively transmit the first voltage to the third light-emitting unit 30. The fourth transistor 22*a* and the fifth transistor 22*b* connected in series are connected between the first terminal of the second power-supply terminal Veven and the light-emitting element 31. Specifically, the fourth transistor 22*a* and the fifth transistor 22*b* each have a control terminal, a first terminal, and a second terminal. The fourth transistor 22*a* has the control terminal for receiving the data signal Data, the first terminal electrically connected with the second power-supply terminal Veven to receive the first voltage from the second power-supply terminal Veven, and the second terminal electrically connected with the first terminal of the fifth transistor 22*b*. The fifth transistor 22*b* has the control terminal for receiving the second scanning signal Scan2, and the second terminal electrically connected with the first terminal of the light-emitting element 31.

When the control terminal of the fourth transistor 22*a* receives the data signal Data and the second scanning signal Scan2 is at the first level, the fourth transistor 22*a* and the fifth transistor 22*b* each are in an on state, and the first voltage is transmitted to the first terminal of the light-emitting element 31 through the fourth transistor 22*a* and the fifth transistor 22*b*.

When the control terminal of the fourth transistor 22*a* receives the data signal Data and the second scanning signal Scan2 is at the second level, the fourth transistor 22*a* is in an on state, the fifth transistor 22*b* is in an off state, and the first voltage is unable to be transmitted to the first terminal of the light-emitting element 31 through the fourth transistor 22*a* and the fifth transistor 22*b*.

As illustrated in FIG. 2, in a specifical implementation of the present disclosure, the fourth light-emitting driving circuit 24 may include a sixth transistor 24*a*. The sixth transistor 24*a* has a control terminal, a first terminal, and a second terminal. The sixth transistor 24*a* has the control terminal for receiving the second scanning signal Scan2, the first terminal electrically connected with the second terminal of the light-emitting element 31, and the second terminal electrically connected with the first power-supply terminal Vodd to receive the second voltage from the first power-supply terminal Vodd.

When the second scanning signal Scan2 received by the sixth transistor 24*a* is at the first level, the sixth transistor 24*a* is in an on state, and the second voltage is transmitted to the second terminal of the light-emitting element 31 through the sixth transistor 24*a*.

When the second scanning signal Scan2 received by the sixth transistor 24*a* is at the second level, the sixth transistor 24*a* is in an off state, and the second voltage is unable to be transmitted to the second terminal of the light-emitting element 31 through the sixth transistor 24*a*.

In implementations of the present disclosure, the first transistor 12*a*, the second transistor 12*b*, the third transistor 14*a*, the fourth transistor 22*a*, the fifth transistor 22*b*, and the sixth transistor 24*a* each may be a Metal-Oxide-Semiconductor Field-Effect Transistor (MOSFET), or a MOS transistor for short. Specifically, the first transistor 12*a*, the second transistor 12*b*, the third transistor 14*a*, the fourth transistor 22*a*, the fifth transistor 22*b*, and the sixth transistor 24*a* each may be a N-type MOS transistor or a P-type transistor, which is not specifically limited in the present disclosure.

In implementations of the present disclosure, the first terminal may be a Drain (D) of each transistor, the second terminal may be a Source (S) of each transistor, and the control terminal may be a Gate (G) of each transistor, which are not specifically limited in the present disclosure.

In implementations of the present disclosure, the first level may be a high level, and the second level may be a low level, which are not specifically limited in the present disclosure.

In implementations of the present disclosure, the first driving module 10 and the second driving module 20 are disposed. By disposing the first light-emitting driving circuit 12 and the second light-emitting driving circuit 14 in the first driving module 10, the first light-emitting driving circuit 12 can apply the first voltage to the first terminal of the light-emitting element 31, and the second light-emitting driving circuit 14 can apply the second voltage to the second terminal of the light-emitting element 31. By disposing the third light-emitting driving circuit 22 and the fourth light-emitting driving circuit 24 in the second driving module 20, the third light-emitting driving circuit 22 can apply the first voltage to the first terminal of the light-emitting element 31, and the fourth light-emitting driving circuit 24 can apply the second voltage to the second terminal of the light-emitting element 31. By controlling a level of the first scanning signal Scan1 transmitted to the first driving module 10 and a level of the second scanning signal Scan2 transmitted to the second driving module 20, the first driving module 10 and the second driving module 20 alternately apply both the first voltage and the second voltage to the light-emitting element 31, to drive the light-emitting unit 30 to emit the light, such that transistors of the first driving module 10 and transistors of the second driving module 20 can transmit the voltage intermittently, and the heat generated due to transmission of the voltage is released during the intermittent period, thereby reducing the operating temperature of each transistor. Further, it is beneficial to prolonging the service life of each transistor.

In implementations of the present disclosure, when the control terminal of the first transistor 12*a* receives the data signal Data and the first scanning signal Scan1 is at the first level, the first voltage is transmitted from the first power-supply terminal Vodd, and the second voltage is transmitted from the second power-supply terminal Veven. When the control terminal of the fourth transistor 22*a* receives the data signal Data and the second scanning signal Scan2 is at the second level, the second voltage is transmitted from the first power-supply terminal Vodd, and the first voltage is transmitted from the second power-supply terminal Veven.

Referring to FIG. 1 and FIG. 2 together, an operating process of the pixel driving circuit 100 is generally described below.

When the control terminal of the first transistor 12*a* receives the data signal Data and the first scanning signal Scan1 is at the first level, the first transistor 12*a*, the second transistor 12*b* and the third transistor 14*a* each in an on state, the first voltage is transmitted to the first terminal of the light-emitting element 31 through the first transistor 12*a* and the second transistor 12*b*, and the second voltage is transmitted to the second terminal of the light-emitting element 31 through the third transistor 14*a*. Here, the light-emitting element 31 is driven by the first driving module 10 to emit the light.

When the control terminal of the fourth transistor 22*a* receives the data signal Data and the second scanning signal Scan2 is at the first level, the fourth transistor 22*a*, the fifth transistor 22*b*, and the sixth transistor 24*a* each are in an on state, the first voltage is transmitted to the first terminal of the light-emitting element 31 through the fourth transistor 22*a* and the fifth transistor 22*b*, and the second voltage is transmitted to the second terminal of the light-emitting element 31 through the sixth transistor 24*a*. Here, the light-emitting element 31 is driven by the second driving module 20 to emit the light.

With switch between the level of the first scanning signal Scan1 and the level of the second scanning signal Scan2, the first driving module 10 and the second driving module 20 alternately drive the light-emitting unit 30 to emit the light.

As illustrated in FIG. 2, in an implementation of the present disclosure, the pixel driving circuit 100 may further include the signal short-circuit 50. The signal short-circuit 50 is electrically connected with both the first driving module 10 and the second driving module 20. During switch between the first driving module 10 and the second driving module 20 to drive the light-emitting unit 30 to emit the light, the first scanning signal Scan1 and the second scanning signal Scan2 are short-circuited by the signal short-circuit 50, so as to realize charge sharing between the first scanning signal Scan1 and the second scanning signal Scan2. Therefore, power consumption required for switch between the level of the first scanning signal Scan1 and the level of the second scanning signal Scan2 can be further reduced, thereby reducing the power consumption of the pixel driving circuit 100.

It can be understood that the so-called charge sharing means that during a period of high-low level switch of the scanning signal, that is, during a period when the first level is switched to the second level, the first level and the second level are short-circuited together, such that a speed at which the first level changes to the second level is increased, and a speed at which the second level changes to the first level is also increased. In other words, during the period when the first level is switched to the second level, the first level of a signal and the second level of a signal are short-circuited together, such that the speed at which the first level changes to the second level is increased, a cycle of switch between the first level and the second level is shortened, and a frequency of the switch between the first level and the second level is increased. When this frequency reaches a preset frequency value, the power consumption of the light-emitting unit can be effectively saved.

It should be noted that FIG. 2 only schematically shows an electrical connection relationship between circuits, and has no influence on limiting the number of components and physical positions of the components. Specifically, the first scanning signal Scan1 transmitted to the second transistor 12*b* and the first scanning signal Scan1 transmitted to the third transistor 14*a* may be provided by one signal controller, or respectively provided by two signal controllers, which is not specifically limited in the present disclosure.

The second scanning signal Scan2 transmitted to the fifth transistor 22*b* and the second scanning signal Scan 2 transmitted to the sixth transistor 24*a* may be provided by one signal controller, or respectively provided by two signal controllers, which is not specifically limited in the present disclosure.

In an implementation of the present disclosure, the signal short-circuit 50 may include several switch sub-circuits. When the first scanning signal Scan1 transmitted to the second transistor 12*b* and the first scanning signal Scan1 transmitted to the third transistor 14*a* are provided by one signal controller, and the second scanning signal Scan2 transmitted to the fifth transistor 22*b* and the second scanning signal Scan2 transmitted to the sixth transistor 24*a* are provided by another signal controller, the signal short-circuit 50 includes one switch sub-circuit, and the switch sub-circuit has a control terminal, a first terminal, and a second terminal. The switch sub-circuit has the control terminal for receiving a third scanning signal Scan3, the first terminal electrically connected with the control terminal of the second transistor 12*b* and the control terminal of the third transistor 14*a*, and the second terminal electrically connected with the control terminal of the fifth transistor 22*b* and the control terminal of the sixth transistor 24*a*, such that the first scanning signal Scan1 and the second scanning signal Scan2 are short-circuited. Since the first driving module 10 and the second driving module 20 alternately provide the light-emitting unit 30 with both the first voltage and the second voltage, the first driving module 10 and the second driving module 20 are alternately switched to provide the light-emitting unit 30 with voltages at opposite levels, under the control of the first scanning signal Scan1 and the second scanning signal Scan2. Therefore, when the first scanning signal Scan1 and the second scanning signal Scan2 are short-circuited, the power consumption during switch between the level of the first scanning signal Scan1 and the level of the second scanning signal Scan2 can be effectively reduced.

For example, when the first driving module 10 is ready to be switched to the second driving module 20 to provide the light-emitting 30 with the first voltage and the second voltage, the first scanning signal Scan1 is at the first level, and the second scanning signal Scan2 is at the second level. Here, the first scanning signal Scan1 and the second scanning signal Scan2 are short-circuited, and the first scanning signal Scan1 transmits charges at the first level to the second scanning signal Scan2, such that the level of the first scanning signal Scan1 is reduced, and the level of the second scanning signal Scan2 is increased, thereby effectively reducing power consumption of level switch.

As illustrated in FIG. 2, in an implementation of the present disclosure, when the first scanning signal Scan1 transmitted to the second transistor 12*b* and the first scanning signal Scan1 transmitted to the third transistor 14*a* are respectively provided by two signal controllers, the second scanning signal Scan2 transmitted to the fifth transistor 22*b* and the second scanning signal Scan2 transmitted to the sixth transistor 24*a* are each provided by the other two signal controllers respectively, the signal short-circuit 50 includes two switch sub-circuits, which may be defined as a first switch sub-circuit 52 and a second switch sub-circuit 54 respectively. The first switch sub-circuit 52 and the second switch sub-circuit 54 each have a control terminal, a first terminal, and a second terminal.

Specifically, the first switch sub-circuit 52 has the control terminal for receiving the third scanning signal Scan3, the first terminal electrically connected with the control terminal of the third transistor 14*a*, and the second terminal electrically connected with the control terminal of the sixth transistor 24*a*. The second switch sub-circuit 54 has the control terminal for receiving the third scanning signal Scan3, the first terminal electrically connected with the control terminal of the fifth transistor 22*b*, and the second terminal electrically connected with the control terminal of the second transistor 12*b*.

Since the first driving module 10 and the second driving module 20 alternately provide the light-emitting unit 30 with both the first voltage and the second voltage, under the control of the first scanning signal Scan1 and the second scanning signal Scan2, the first driving module 10 and the second driving module 20 are alternately switched to provide the light-emitting unit 30 with voltages at opposite levels, under the control of the first scanning signal Scan1 and the second scanning signal Scan2. Therefore, when the first scanning signal Scan1 and the second scanning signal Scan2 are short-circuited, the power consumption during switch between the level of the first scanning signal Scan1 and the level of the second scanning signal Scan2 can be effectively reduced.

In an implementation of the present disclosure, the first switch sub-circuit 52 may include a first shared transistor 52*a*. The second switch sub-circuit 54 may include a second shared transistor 54*a*. The first sensed transistor 52*a* has a control terminal for receiving the first scanning signal Scan3, a first terminal electrically connected with the control terminal of the third transistor 14*a*, and the second terminal electrically connected with the control terminal of the sixth transistor 24*a*.

The second shared transistor 54*a* has a control terminal for receiving the third scanning signal Scan3, a first terminal electrically connected with the control terminal of the fifth transistor 22*b*, and a second terminal electrically connected with the control terminal of the second transistor 12*b*.

Figure 3:
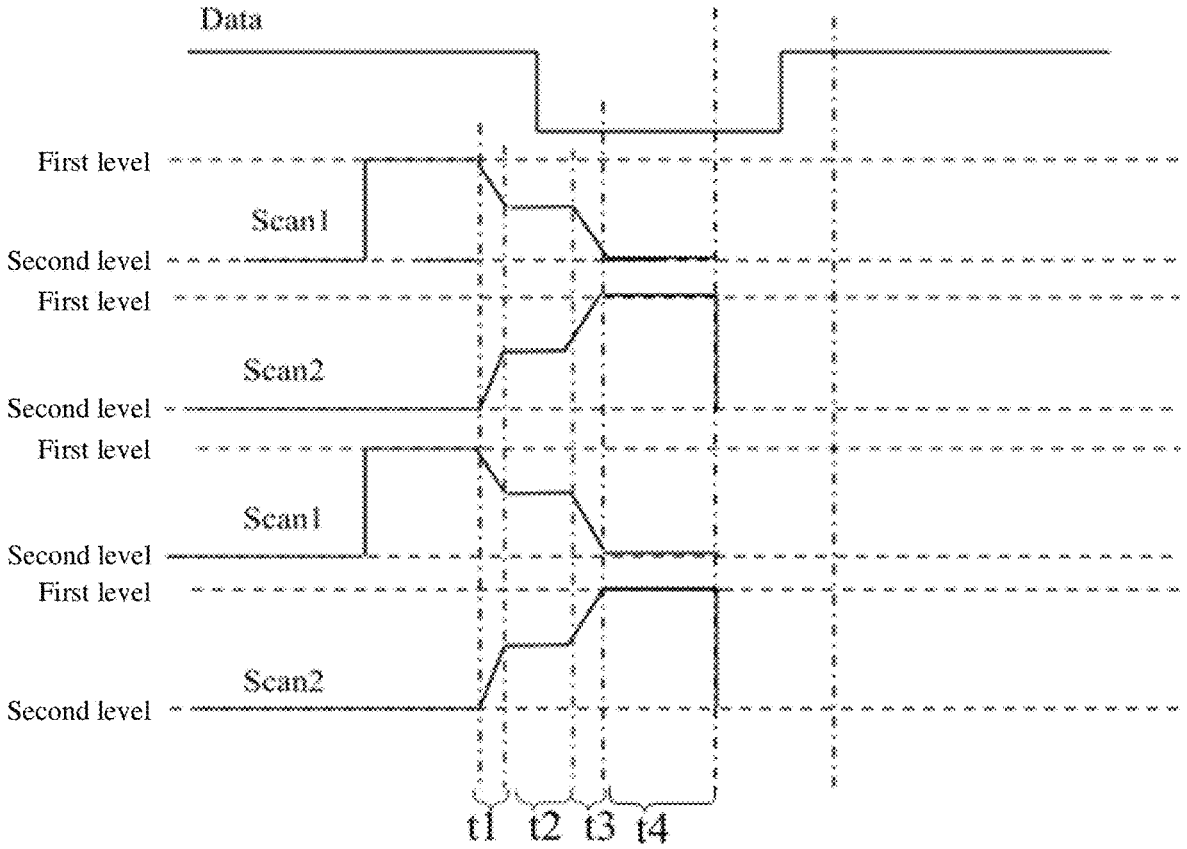
FIG. 3 is a driving sequence diagram of the pixel driving circuit illustrated in FIG. 2.

Referring to FIG. 3, FIG. 3 is a driving sequence diagram of the pixel driving circuit 100 illustrated in FIG. 2. As illustrated in FIG. 3, in implementations of the present disclosure, a curve corresponding to the data signal Data is a sequence of the data signal Data, a curve corresponding to the first scanning signal Scan1 is a sequence of the first scanning signal Scan1, a curve corresponding to the second scanning signal Scan2 is a sequence of the second scanning signal Scan2.

It can be seen from the figure that the first scanning signal Scan1 corresponds to two curves, which indicates that in the pixel driving circuit 100, the first scanning signal Scan1 transmitted to the second transistor 12*b* and the first scanning signal Scan1 transmitted to the third transistor 14*a* are respectively provided by two signal controllers, so there are two curves. However, since functions of first scanning signals Scan1 are the same, sequences of the two curves are the same. The second scanning signal Scan2 corresponds to two curves, which indicates that in the pixel driving circuit 100, the second scanning signal Scan2 transmitted to the fifth transistor 22*b* and the second scanning signal Scan2 transmitted to the sixth transistor 24*a* are respectively provided by two signal controllers, so there are two curves. However, since functions of second scanning signals Scan2 are the same, sequences of the two curves are the same.

In implementations of the present disclosure, the magnitude of the data signal Data is used to adjust the magnitude of the current flowing through the light-emitting element 31, that is, to adjust the light-emitting brightness of the light-emitting element 31. A high or low level of the data signal Data corresponds to different light-emitting brightnesses of the light-emitting element 31.

As illustrated in FIG. 3, a case where the first scanning signal Scan1 is at the first level and the second level is opposite to a case where the second scanning signal Scan2 is at the second level, that is, it reflects that the first driving module 10 and the second driving module 20 alternately drive the light-emitting unit 30 to emit the light.

As illustrated in FIG. 3, the sequence begins, and the first driving module 10 drives the light-emitting unit 30 to emit the light.

In period t1, a left endpoint of period t1 indicates that the pixel driving circuit 100 is ready to switch from the first driving module 10 to the second driving module 20 to drive the light-emitting unit 30 to emit the light.

In period t1, the signal short-circuit 50 short-circuits the first scanning signal Scan1 and the second scanning signal Scan2, to realize charge sharing between the first scanning signal Scan1 and the second scanning signal Scan2. It can be seen from the figure that at a right endpoint of period t1, the charge sharing between the first scanning signal Scan1 and the second scanning signal Scan2 is completed, and the level of the first scanning signal Scan1 and the level of the second scanning signal Scan2 tend to be at an intermediate position of the first level and the second level.

In the entire period t2, the level of the first scanning signal Scan1 and the level of the second scanning signal Scan2 each tend to be unchanged and at the intermediate position of the first level and the second level.

In period t3, the signal controller outputs the second scanning signal Scan2, such that the second scanning signal Scan2 continuously raises to the first level.

In period t4, when the second scanning signal Scan2 is at the first level, the second driving module 20 drives the light-emitting unit 30 to emit the light. Here, the first scanning signal Scan1 is at the second level.

Therefore, by controlling the level of the first scanning signal Scan1 transmitted to the first driving module 10 and the level of the second scanning signal Scan2 transmitted to the second driving module 20, the first driving module 10 and the second driving module 20 alternately drive the light-emitting unit 30 to emit the light.

Based on the same concept, a display panel is further disclosed in implementations of the present disclosure. The display panel includes several above-mentioned pixel driving circuits 100 and a signal controller. The signal controller is configured to provide the several pixel driving circuits 100 with the first scanning signal Scan1 and the second scanning signal Scan2.

Based on the same concept, a display device is further disclosed in implementations of the present disclosure. The display device includes the above-mentioned display panel and a power-supply module. The power-supply module is configured to supply power to the display panel for displaying an image.

In summary, in the pixel driving circuit 100, the display panel, and the display device of the present disclosure, the pixel driving circuit 100 is provided with the first driving module 10 and the second driving module 20. By disposing the first light-emitting driving circuit 12 and the second light-emitting driving circuit 14 in the first driving module 10, the first light-emitting driving circuit 12 can apply the first voltage to the first terminal of the light-emitting element 31, and the second light-emitting driving circuit 14 can apply the second voltage to the second terminal of the light-emitting element 31. By disposing the third light-emitting driving circuit 22 and the fourth light-emitting driving circuit 24 in the second driving module 20, the third light-emitting driving circuit 22 can apply the first voltage to the first terminal of the light-emitting element 31, and the fourth light-emitting driving circuit 24 can apply the second voltage to the second terminal of the light-emitting element 31. By controlling the level of the first scanning signal Scan1 transmitted to the first driving module 10 and the level of the second scanning signal Scan2 transmitted to the second driving module 20, the first driving module 10 and the second driving module 20 alternately drive the light-emitting unit 30 to emit the light. Therefore, transistors of the first driving module 10 and transistors of the second driving module 20 can transmit the voltage intermittently, and the heat generated due to transmission of the voltage is released during the intermittent period, thereby reducing the operating temperature of each transistor, which is beneficial to prolonging the service life of each transistor, and further improving the service life of the display panel and the service life of the display device.

In addition, the signal short-circuit 50 is disposed in the pixel driving circuit 100, and during the period between the first driving module 10 is switched to drive the light-emitting unit 30 to emit the light and the second driving module 20 is switched to drive the light-emitting unit 30 to emit the light, the first scanning signal Scan1 and the second scanning signal Scan2 are short-circuited by the signal short-circuit 50, so as to realizing the charge sharing between the first scanning signal Scan1 and the second scanning signal Scan2. Therefore, the power consumption required for the switch between the level of the first scanning signal Scan1 and the level of the second scanning signal Scan2 can be reduced, thereby reducing the power consumption of the pixel driving circuit 100, and further effectively reducing the power consumption of the display panel and the power consumption of the display device.

All possible combinations of respective technical features in the above implementations are described. However, as long as there is no contradiction in the combinations of these technical features, the combinations of these technical features should be considered to be within the scope of the present specification.

The reference term "an implementation", "some implementations", "an exemplary implementation", "an embodiment", "a specific embodiment", or "some embodiments" referred to herein means that a particular feature, structure, material, or characteristic described in conjunction with implementations or embodiments may be contained in at least one implementation or embodiment of the present disclosure. The exemplary expressions of the above terms appearing in the specification does not necessarily refer to the same implementation or embodiment. Furthermore, the particular feature, structure, material, or characteristic described may be properly combined in any one or more implementations or embodiments.

It should be understood that the above implementations only show several implementations of the present disclosure, and the descriptions thereof are relatively specific and detailed, but cannot be understood as a limitation to the scope of the present disclosure. It should be noted that for those of ordinary skill in the art, without departing from the concept of the present disclosure, several modifications and improvements can be made, and these all belong to the protection scope of the present disclosure. Therefore, the protection scope of the present disclosure shall be referred to the appended claims.

What is claimed is:

1. A pixel driving circuit, comprising a first driving module and a light-emitting unit, wherein the pixel driving circuit further comprises a second driving module, and the first driving module and the second driving module each are electrically connected with the light-emitting unit, a first power-supply terminal, and a second power-supply terminal, the first driving module is configured to receive a first scanning signal and a data signal, and selectively receive a first voltage from the first power-supply terminal and receive a second voltage from the second power-supply terminal according to the first scanning signal and the data signal;

the second driving module is configured to receive a second scanning signal and the data signal, and selectively receive the second voltage from the first power-supply terminal and receive the first voltage from the second power-supply terminal according to the second scanning signal and the data signal; and the first voltage and the second voltage that are received by the first driving module and the first voltage and the second voltage that are received by the second driving module are used to be alternately applied across the light-emitting unit, to drive the light-emitting unit to emit a light.

2. The pixel driving circuit of claim 1, wherein the first driving module comprises a first light-emitting driving circuit and a second light-emitting driving circuit, and the first light-emitting driving circuit has a first end electrically connected with the first power-supply terminal to receive the first voltage from the first power-supply terminal, and a second end electrically connected with the light-emitting unit; and the second light-emitting driving circuit has a first end electrically connected with the light-emitting unit, and a second end electrically connected with the second power-supply terminal to receive the second voltage from the second power-supply terminal.

3. The pixel driving circuit of claim 2, wherein the second driving module comprises a third light-emitting driving circuit and a fourth light-emitting driving circuit, and the third light-emitting driving circuit has a first end electrically connected with the second power-supply terminal to receive the first voltage from the second power-supply terminal, and a second end terminal electrically connected with the light-emitting unit; and the fourth light-emitting driving circuit has a first end electrically connected with the first power-supply terminal to receive the second voltage from the first power-supply terminal, and a end terminal electrically connected with the light-emitting unit.

4. The pixel driving circuit of claim 3, wherein the light-emitting unit comprises a light-emitting element, the light-emitting element has a first terminal and a second terminal, and the first terminal of the light-emitting element and the second terminal of the light-emitting element each are electrically connected with the first driving module and the second driving module.

5. The pixel driving circuit of claim 4, wherein the first light-emitting driving circuit comprises a first transistor and a second transistor, the second light-emitting driving circuit comprises a third transistor, the first transistor has a control terminal for receiving the data signal, a first terminal electrically connected with the first power-supply terminal to receive the first voltage from the first power-supply terminal, and a second terminal electrically connected with a first terminal of the second transistor, and the second transistor has a control terminal for receiving the first scanning signal, and a second terminal electrically connected with the first terminal of the light-emitting element; and the third transistor has a control terminal for receiving the first scanning signal, a first terminal electrically connected with the second terminal of the light-emitting element, and a second terminal electrically connected with the second power-supply terminal to receive the second voltage from the second power-supply terminal.

6. The pixel driving circuit of claim 5, wherein the third light-emitting driving circuit comprises a fourth transistor and a fifth transistor, the fourth light-emitting driving circuit comprises a sixth transistor, the fourth transistor has a control terminal for receiving the data signal, a first terminal electrically connected with the second power-supply terminal to receive the first voltage from the second power-supply terminal, and a second terminal electrically connected with a first terminal of the fifth transistor, and the fifth transistor has a control terminal for receiving the second scanning signal, and a second terminal electrically connected with the first terminal of the light-emitting element; and the sixth transistor has a control terminal for receiving the second scanning signal, a first terminal electrically connected with the second terminal of the light-emitting element, and a second terminal electrically connected with the first power-supply terminal to receive the second voltage from the first power-supply terminal.

7. The pixel driving circuit of claim 6, wherein when the control terminal of the first transistor receives the data signal and the first scanning signal is at a first level, the first transistor, the second transistor, and the third transistor each are in an on state, the first voltage is transmitted to the first terminal of the light-emitting element through the first transistor and the second transistor, the second voltage is transmitted to the second terminal of the light-emitting element through the third transistor, and the light-emitting element is driven by the first voltage and the second voltage to emit the light; and when the control terminal of the fourth transistor receives the data signal and the second scanning signal is at the first level, the fourth transistor, the fifth transistor, and the sixth transistor each are in an on state, the first voltage is transmitted to the first terminal of the light-emitting element through the fourth transistor and the fifth transistor, the second voltage is transmitted to the second terminal of the light-emitting element through the sixth transistor, and the light-emitting element is driven by the first voltage and the second voltage to emit the light.

8. The pixel driving circuit of claim 1, further comprising a signal short-circuit, wherein the signal short-circuit comprises several switch sub-circuits, the several switch sub-circuits each are electrically connected with both the first driving module and the second driving module, and during switch between the first driving module and the second driving module to drive the light-emitting unit to emit the light, the first scanning signal and the second scanning signal are short-circuited by each of the several switch sub-circuits.

9. A display panel comprising a signal controller and several pixel driving circuits, wherein the several pixel driving circuits each comprise a first driving module and a light-emitting unit, wherein the pixel driving circuit further comprises a second driving module, and the first driving module and the second driving module each are electrically connected with the light-emitting unit, a first power-supply terminal, and a second power-supply terminal, the first driving module is configured to receive a first scanning signal and a data signal, and selectively receive a first voltage from the first power-supply terminal and receive a second voltage from the second power-supply terminal according to the first scanning signal and the data signal;

the second driving module is configured to receive a second scanning signal and the data signal, and selectively receive the second voltage from the first power-supply terminal and receive the first voltage from the second power-supply terminal according to the second scanning signal and the data signal; and the first voltage and the second voltage that are received by the first driving module and the first voltage and the second voltage that are received by the second driving module are used to be alternately applied across the light-emitting unit, to drive the light-emitting unit to emit a light, wherein the signal controller is configured to provide the several pixel driving circuits with the first scanning signal and the second scanning signal.

10. The display panel of claim 9, wherein the first driving module comprises a first light-emitting driving circuit and a second light-emitting driving circuit, and the first light-emitting driving circuit has a first end electrically connected with the first power-supply terminal to receive the first voltage from the first power-supply terminal, and a second end electrically connected with the light-emitting unit; and the second light-emitting driving circuit has a first end electrically connected with the light-emitting unit, and a second end electrically connected with the second power-supply terminal to receive the second voltage from the second power-supply terminal.

11. The display panel of claim 10, wherein the second driving module comprises a third light-emitting driving circuit and a fourth light-emitting driving circuit, and the third light-emitting driving circuit has a first end electrically connected with the second power-supply terminal to receive the first voltage from the second power-supply terminal, and a second end terminal electrically connected with the light-emitting unit; and the fourth light-emitting driving circuit has a first end electrically connected with the first power-supply terminal to receive the second voltage from the first power-supply terminal, and a end terminal electrically connected with the light-emitting unit.

12. The display panel of claim 11, wherein the light-emitting unit comprises a light-emitting element, the light-emitting element has a first terminal and a second terminal, and the first terminal of the light-emitting element and the second terminal of the light-emitting element each are electrically connected with the first driving module and the second driving module.

13. The display panel of claim 12, wherein the first light-emitting driving circuit comprises a first transistor and a second transistor, the second light-emitting driving circuit comprises a third transistor, the first transistor has a control terminal for receiving the data signal, a first terminal electrically connected with the first power-supply terminal to receive the first voltage from the first power-supply terminal, and a second terminal electrically connected with a first terminal of the second transistor, and the second transistor has a control terminal for receiving the first scanning signal, and a second terminal electrically connected with the first terminal of the light-emitting element; and the third transistor has a control terminal for receiving the first scanning signal, a first terminal electrically connected with the second terminal of the light-emitting element, and a second terminal electrically connected with the second power-supply terminal to receive the second voltage from the second power-supply terminal.

14. The display panel of claim 13, wherein the third light-emitting driving circuit comprises a fourth transistor and a fifth transistor, the fourth light-emitting driving circuit comprises a sixth transistor, the fourth transistor has a control terminal for receiving the data signal, a first terminal electrically connected with the second power-supply terminal to receive the first voltage from the second power-supply terminal, and a second terminal electrically connected with a first terminal of the fifth transistor, and the fifth transistor has a control terminal for receiving the second scanning signal, and a second terminal electrically connected with the first terminal of the light-emitting element; and the sixth transistor has a control terminal for receiving the second scanning signal, a first terminal electrically connected with the second terminal of the light-emitting element, and a second terminal electrically connected with the first power-supply terminal to receive the second voltage from the first power-supply terminal.

15. The display panel of claim 14, wherein when the control terminal of the first transistor receives the data signal and the first scanning signal is at a first level, the first transistor, the second transistor, and the third transistor each are in an on state, the first voltage is transmitted to the first terminal of the light-emitting element through the first transistor and the second transistor, the second voltage is transmitted to the second terminal of the light-emitting element through the third transistor, and the light-emitting element is driven by the first voltage and the second voltage to emit the light; and when the control terminal of the fourth transistor receives the data signal and the second scanning signal is at the first level, the fourth transistor, the fifth transistor, and the sixth transistor each are in an on state, the first voltage is transmitted to the first terminal of the light-emitting element through the fourth transistor and the fifth transistor, the second voltage is transmitted to the second terminal of the light-emitting element through the sixth transistor, and the light-emitting element is driven by the first voltage and the second voltage to emit the light.

16. The display panel of claim 9, wherein the pixel driving circuit further comprises a signal short-circuit, wherein the signal short-circuit comprises several switch sub-circuits, the several switch sub-circuits each are electrically connected with both the first driving module and the second driving module, and during switch between the first driving module and the second driving module to drive the light-emitting unit to emit the light, the first scanning signal and the second scanning signal are short-circuited by each of the several switch sub-circuits.

17. A display device comprising a power-supply module and a display panel, wherein the power-supply module is configured to supply power to the display panel, the display panel comprises a signal controller and several pixel driving circuits, the several pixel driving circuits each comprise a first driving module and a light-emitting unit, wherein the pixel driving circuit further comprises a second driving module, and the first driving module and the second driving module each are electrically connected with the light-emitting unit, a first power-supply terminal, and a second power-supply terminal, the first driving module is configured to receive a first scanning signal and a data signal, and selectively receive a first voltage from the first power-supply terminal and receive a second voltage from the second power-supply terminal according to the first scanning signal and the data signal;

the second driving module is configured to receive a second scanning signal and the data signal, and selectively receive the second voltage from the first power-supply terminal and receive the first voltage from the second power-supply terminal according to the second scanning signal and the data signal; and the first voltage and the second voltage that are received by the first driving module and the first voltage and the second voltage that are received by the second driving module are used to be alternately applied across the light-emitting unit, to drive the light-emitting unit to emit a light, wherein the signal controller is configured to provide the several pixel driving circuits with the first scanning signal and the second scanning signal.

18. The display device of claim 17, wherein the first driving module comprises a first light-emitting driving circuit and a second light-emitting driving circuit, and the first light-emitting driving circuit has a first end electrically connected with the first power-supply terminal to receive the first voltage from the first power-supply terminal, and a second end electrically connected with the light-emitting unit; and the second light-emitting driving circuit has a first end electrically connected with the light-emitting unit, and a second end electrically connected with the second power-supply terminal to receive the second voltage from the second power-supply terminal.

19. The display device of claim 18, wherein the second driving module comprises a third light-emitting driving circuit and a fourth light-emitting driving circuit, and the third light-emitting driving circuit has a first end electrically connected with the second power-supply terminal to receive the first voltage from the second power-supply terminal, and a second end terminal electrically connected with the light-emitting unit; and the fourth light-emitting driving circuit has a first end electrically connected with the first power-supply terminal to receive the second voltage from the first power-supply terminal, and a end terminal electrically connected with the light-emitting unit.

20. The display device of claim 19, wherein the light-emitting unit comprises a light-emitting element, the light-emitting element has a first terminal and a second terminal, and the first terminal of the light-emitting element and the second terminal of the light-emitting element each are electrically connected with the first driving module and the second driving module.

* * * * *